US007621698B2

(12) United States Patent
Pallini, Jr. et al.

(10) Patent No.: US 7,621,698 B2
(45) Date of Patent: Nov. 24, 2009

(54) ROTATING LOCK RING BOTTOM TENDON CONNECTOR

(75) Inventors: Joseph W. Pallini, Jr., Tomball, TX (US); Jesse B. Riha, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 302 days.

(21) Appl. No.: 11/866,734

(22) Filed: Oct. 3, 2007

(65) Prior Publication Data

US 2009/0092448 A1 Apr. 9, 2009

(51) Int. Cl.
*E02D 5/74* (2006.01)

(52) U.S. Cl. ..... 405/223.1; 405/224

(58) Field of Classification Search ..... 405/223.1, 405/224, 224.2, 227, 195.1
See application file for complete search history.

(56) References Cited

U.S. PATENT DOCUMENTS

| | | | | | |
|---|---|---|---|---|---|
| 4,459,933 | A * | 7/1984 | Burchett | 405/224 |
| 4,611,953 | A * | 9/1986 | Owens | 405/224 |
| 4,664,558 | A * | 5/1987 | De Meio et al. | 405/224 |
| 4,797,036 | A * | 1/1989 | Collins et al. | 405/224 |
| 4,869,615 | A * | 9/1989 | Galle | 405/224 |
| 4,943,188 | A * | 7/1990 | Peppel | 405/223.1 |
| 4,968,183 | A * | 11/1990 | Hannus et al. | 405/224 |
| 5,004,272 | A * | 4/1991 | Kipp | 285/24 |
| 5,324,141 | A * | 6/1994 | Hunter et al. | 405/223.1 |
| 5,755,533 | A * | 5/1998 | Snyder et al. | 405/224 |
| 5,984,585 | A * | 11/1999 | Pallini et al. | 405/223.1 |
| RE38,458 | E | 3/2004 | Pallini, Jr. | |
| 2006/0199433 | A1 * | 9/2006 | Riggs et al. | 439/607 |
| 2007/0292213 | A1 * | 12/2007 | Munk et al. | 405/224.2 |
| 2008/0101872 | A1 | 5/2008 | Munk et al. | |

FOREIGN PATENT DOCUMENTS

| | | |
|---|---|---|
| GB | 2033463 A | 5/1980 |
| GB | 2201709 A | 9/1988 |

* cited by examiner

*Primary Examiner*—Frederick L Lagman
(74) *Attorney, Agent, or Firm*—Bracewell & Giuliani

(57) ABSTRACT

A tendon bottom connector assembly has a receptacle with a bore having an annular locking profile divided into segments by axially extending slots. The connector has a housing that inserts into and locks in the receptacle. The housing and receptacle have mating an anti-rotation elements. The lock ring has an outer surface with an annular locking profile divided into segments by axially extending slots. The lock ring is carried by the housing initially in the installation position with its segments aligned with the slots of the receptacle. This position allows the housing to be fully inserted into the receptacle. An ROV then rotates the ring from the installation position to a locked position, with the segments of the lock ring engaging the segments of the receptacle. Alternately, a split ring with one end fixed rotates the lock ring.

22 Claims, 10 Drawing Sheets

ROTATING LOCK RING BOTTOM TENDON CONNECTOR

FIELD OF THE INVENTION

This invention relates in general to securing a shaft of a buoyant structure to a subsea anchor piling, and in particular to a bottom connector for connecting a tendon of a tension leg platform to a receptacle on the sea floor.

BACKGROUND OF THE INVENTION

In certain types of offshore drilling and hydrocarbon production, a shaft extends downward from a buoyant structure and latches into a receptacle on an anchor piling at the sea floor. Tension is applied to the shaft, which is transmitted to the anchor piling. This technique is used for connecting the bottom of a tendon of a tension leg platform to a receptacle mounted at the sea floor. This method is also used for anchoring a riser tower. For convenience, these connectors will be referred to herein as bottom tendon connectors whether used to anchor a tension leg platform, a riser tower, or other buoyant structure.

In the past, bottom tendon connectors have used a fairly lengthy receptacle at the sea floor. The shaft at the lower end of the tendon has a latch member that inserts into the receptacle and latches to the receptacle by axial positioning. In one type, the connector is inserted until the latch member is below the receptacle load interface, then lifted. In another type, the latch member is partially inserted past the load interface, then lifted. To disengage, the connector is inserted deeper into the receptacle and lifted. Another type involves rotating the connector when the connector is fully lowered in the receptacle. These prior art connectors typically require a long receptacle and significant vertical motion or rotation of the entire connector for operation.

Also, in these prior art connectors, the shaft at the lower end of the tendon is fixed relative to the connector body or housing to which it is attached. Normally the shaft will experience only tension after the connection is made up. In rare circumstances, however, due to wave motion or other factors, the tendon may drop downward sufficiently to completely eliminate the tension in the shaft. The prior art types normally do not have provisions for allowing downward movement of the shaft in the event of a momentary loss of tension in the shaft. If the shaft moves downward, it may disengage.

SUMMARY OF THE INVENTION

The connector assembly of this invention has a receptacle with an annular locking profile that is divided into segments by a plurality of axially extending slots. The connector has a housing or body that inserts into and locks in the receptacle. The housing has an outer surface with at least one lug that slides into engagement with one of the slots to prevent rotation of the housing relative to the receptacle.

A lock ring is carried by the housing and has an outer surface with an annular locking profile divided into segments by a plurality of axially extending slots. The lock ring has an installation position wherein its segments vertically align with the slots of the receptacle to enable the housing to be inserted into the receptacle. The lock ring is then rotated from the installation position to a locked position wherein the segments of the lock ring engage the segments of the receptacle.

In a second embodiment, the lock ring automatically rotates from the installation to the locked position as the housing is lowered into the receptacle. In this embodiment, a split ring is mounted around the body and has one end fixed to the body. The other end of the split ring floats and is secured to the lock ring. The split ring is contracted from its natural state as it contacts the receptacle segments. The contraction causes the split ring floating end to move a rotational increment, which in turn shifts the lock ring to the installation position. As the split ring passes below the receptacle segments, it expands and rotates the lock ring back to the locked position.

The connector includes a shaft that extends upward and is connected to a tendon or a riser tower component. The shaft is mounted to an inner body that preferably has a passage that allows the shaft to slide axially relative to the inner body. A flange on the lower portion of the shaft is located below the inner body to provide a limit for upward movement of the shaft relative to the inner body when tension is applied to the shaft. The shaft has a downward facing shoulder above the tubular body to provide a limit for downward movement of the shaft relative to the inner body. The axial distance between the flange and the downward facing shoulder is greater than the length of the passage in the inner body. The distance between the flange and the shoulder allows the shaft to move downward relative to the inner body and the receptacle in the event tension in the shaft momentarily ceases.

The housing surrounds the inner body and the shaft. A flex joint assembly joins the inner body to the housing to enable the shaft and the inner body to incline relative to the housing.

DETAILED DESCRIPTION OF THE INVENTION

Figure 1:
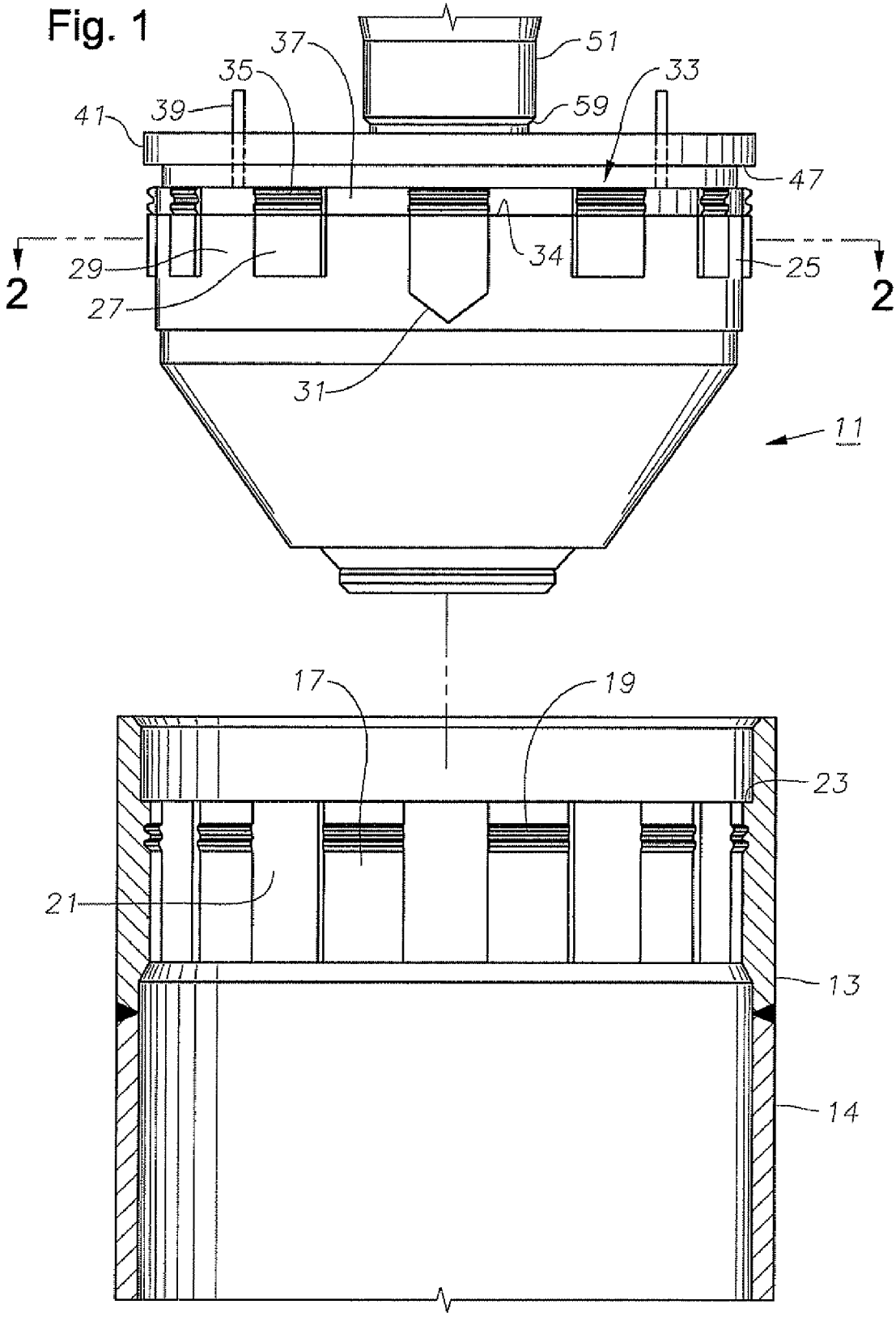
FIG. 1 is a side elevational and sectional view of a bottom tendon connector being inserted into a receptacle, the tendon connector and receptacle being constructed in accordance with this invention.
Figure 4:
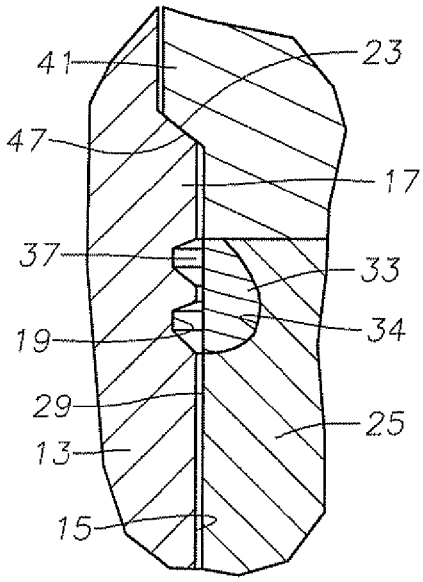
FIG. 4 is a sectional view of part of the connector and receptacle after being stabbed together but prior to locking and taken along the line 4-4 of FIG. 3.

Referring to FIG. 1, subsea connector assembly 11 includes a receptacle 13 located at the sea floor and facing upward. Receptacle 13 is a cylindrical member welded or otherwise secured to a piling 14 that is embedded in the sea floor. Receptacle 13 has a cylindrical bore 15 with a plurality of receptacle segments 17 spaced circumferentially around the inside surface of bore 15. Each receptacle segment 17 has a grooved locking profile 19 formed on it. Profile 19 may vary and in this example comprises two parallel grooves, as illustrated in FIG. 4, the grooves being perpendicular to the axis of bore 15. Receptacle segments 17 are circumferentially spaced apart from each other by vertical receptacle slots 21 that are smooth recesses formed in the sidewall of bore 15.

Figure 3:
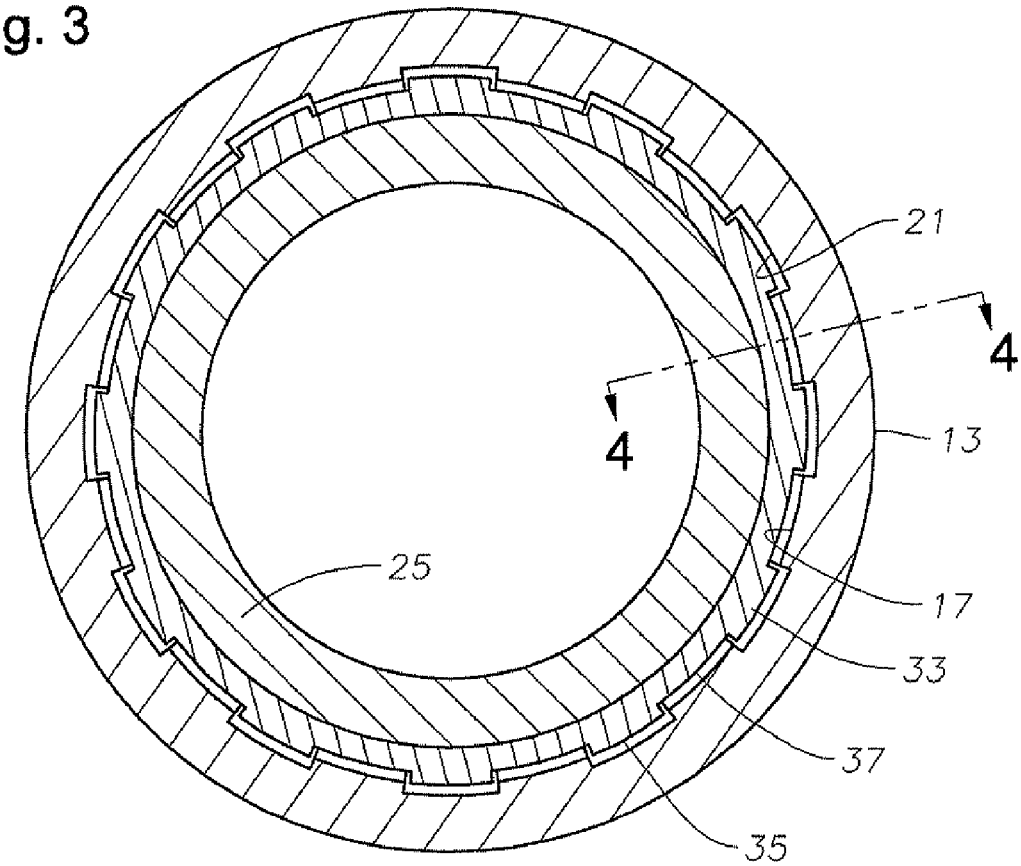
FIG. 3 is a sectional view of the housing similar to FIG. 2, but also showing the housing stabbed into the receptacle, but before the lock ring has been moved to the locked position.

Receptacle segments 17 may be formed by first machining annular grooved profile 19 completely around the inner diameter of receptacle 13, then machining vertical receptacle slots 21 across the profile to define receptacle segments 17. Preferably, each receptacle slot 21 has the same width as each receptacle segment 17, as illustrated in FIG. 3. Each receptacle slot 21 has a greater axial length than grooved profile 19 in this embodiment, resulting in the lower portion of each receptacle segment 17 below profile 19 being smooth and at the same inner diameter as bore 15.

An annular stop shoulder 23 is located in bore 15. Stop shoulder 23 faces upward and is located near the upper end of receptacle 13.

Figure 2:
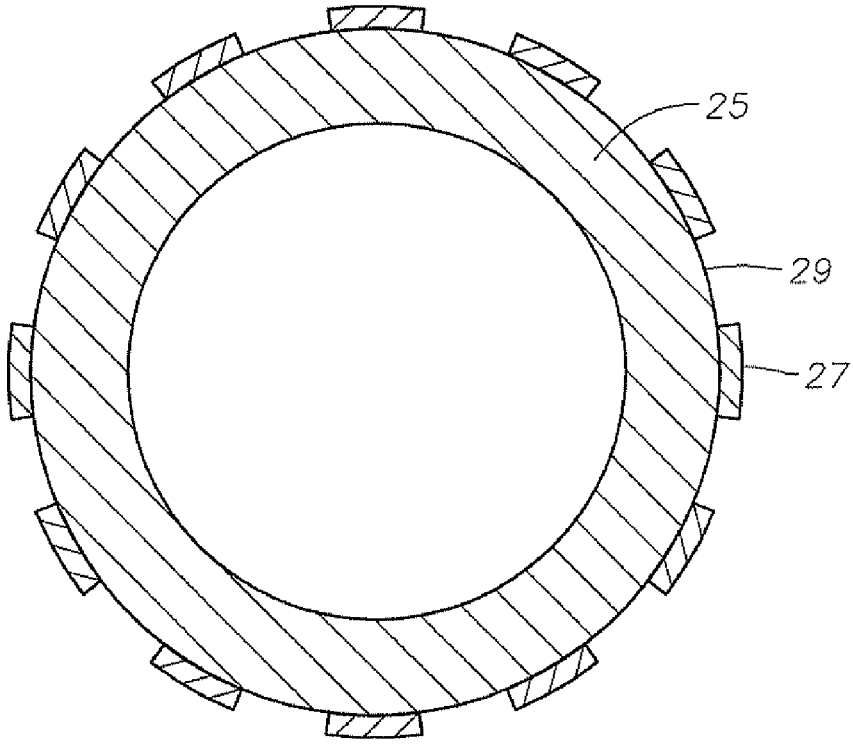
FIG. 2 is a sectional view of the housing of the tendon connector of FIG. 1, taken along the line 2-2 of FIG. 1.

Subsea connector 11 also includes a body or housing 25 that inserts into bore 15 of receptacle 13. Housing 25 and receptacle 13 having mating ant-rotation elements to prevent rotation of housing 25 in receptacle 13. Various elements might be employed. In this example, housing 25 has a generally cylindrical outer surface with at least one lug 27 formed thereon to serve as an anti-rotation element. There may be as many lugs 27 as receptacle slots 21, and each lug 27 has a width that is slightly less than the width of each receptacle slot 21 so that it can slide into one of the receptacle slots 21. Lugs 27 are circumferentially separated from each other by housing slots 29, as shown also in FIG. 2. Each housing slot 29 has the same width as each lug 27 and as each receptacle segment 17. In the preferred embodiment, lugs 27 are fabricated separately and secured to the outer surface of housing 25 by fasteners or welding. Alternately, lugs 27 could be formed by machining recesses into the outer surface to form housing slots 29.

Preferably, at least one or more of the lugs 27 has an extended pointed end 31 that will help orient and guide housing 25 as it is being inserted into receptacle 13. Points 31 rotate housing 25 slightly, if necessary, to align housing lugs 27 with receptacle slots 21. Lugs 27 have smooth outer surfaces with no locking or grooved profile required. Lugs 27 locate within receptacle slots 21 to prevent rotation of housing 25. Although, there are as many lugs 27 as receptacle slots 21 in the preferred embodiment, only one lug 27 would serve to prevent rotation of housing 25.

Referring still to FIG. 1, a solid lock ring 33 is rotatably carried in an annular recess 34 of housing 25. Lock ring 33 also has a plurality of lock ring segments 35, each having a grooved profile formed thereon to mate with grooved profile 19 of receptacle segment 17. Lock ring segments 35 are separated from each other by lock ring recesses 37. Lock ring recesses 37 have the same widths as lock ring segments 35 and are slightly narrower than receptacle slots 21. Lugs 27, lock ring segments 35, and receptacle segments 17 must be slightly narrower than In the released or installation position shown in FIG. 1, lock ring 33 is in a position with its recesses 37 vertically aligned with housing slots 29. Each lock ring segment 35 is located above and in vertical alignment with one of the housing lugs 27. In this position, housing 25 can be fully inserted into receptacle 13. Housing slots 27 will slide over receptacle segments 17. Housing lugs 27 and lock ring segments 35 will slide into receptacle slots 21. FIG. 3 illustrates this position.

Figure 5:
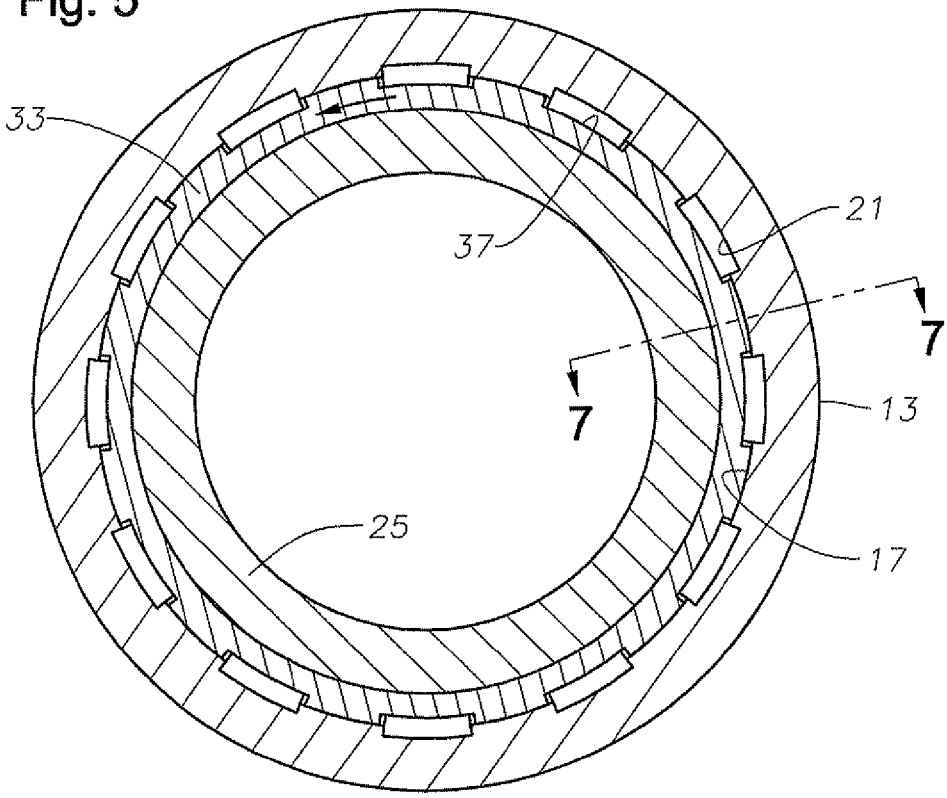
FIG. 5 is a sectional view of the connector similar to FIG. 3, but showing the lock ring rotated to the locked position.
Figure 7:
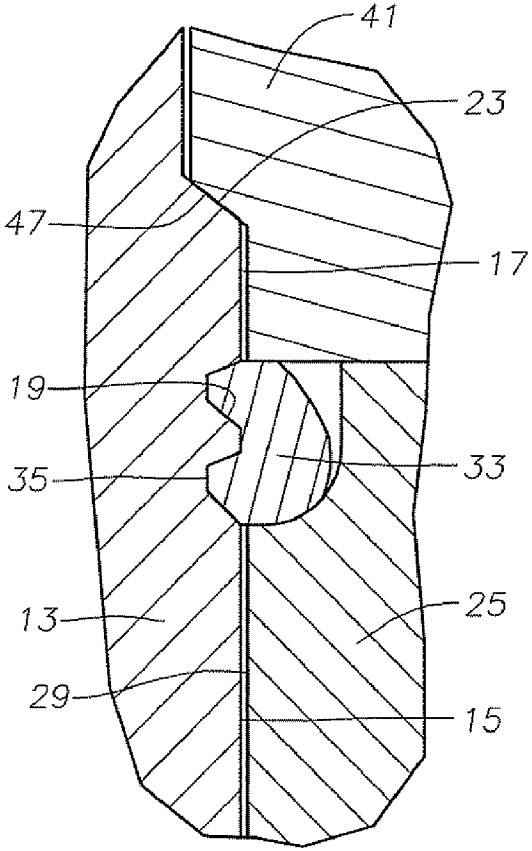
FIG. 7 is a sectional view of the connector and receptacle in the locked position and taken along the line 7-7 of FIG. 5.

Lock ring 33 can be rotated an increment from its installation position of FIGS. 1 and 3 to a locked position shown in FIGS. 5 and 7. When rotated, lock ring segments 35 will slide a few degrees in one direction until meshing into engagement with grooved profiles 19 of receptacle segments 17. Once lock ring 33 is in the locked position, housing 25 cannot be pulled upward from receptacle 13 because of the engagement of lock ring segments 35 and receptacle segments 17. Housing 25 cannot be rotated because of the engagement of housing lugs 27 with receptacle slots 21.

Figure 6:
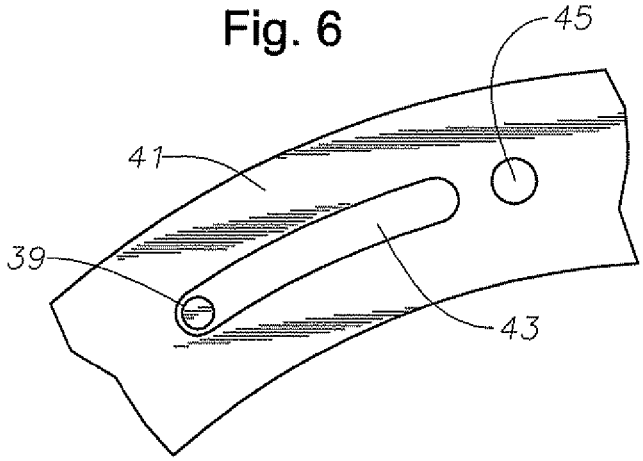
FIG. 6 is a top view of a portion of a cap ring of the connector, and showing the actuator arm in a released position.

Various devices may be employed to rotate lock ring 33 to the locked position after housing 25 has been stabbed into receptacle 13. FIG. 1 illustrates two upward protruding arms 39, although only one would suffice. Each arm 39 comprises a pin that is joined to the upper side of lock ring 33 and protrudes upward above housing 25. In this example, a cap ring 41 is secured to housing 25 above lock ring 33 to retain lock ring 33. As shown in FIG. 6, a curved, elongated slot 43 extends through cap ring 41 for each arm 39. Arm 39 protrudes through aperture 43 and is able to move from one end of aperture 43 to its other end. In the position of FIG. 6, lock ring 33 (FIG. 1) is in its released or installation position. In this position, arm 39 abuts one end of elongated aperture 43. A remote operated vehicle (ROV) can be employed to move arm 39 until it abuts the opposite end of elongated aperture 43. In that position, which is not shown, lock ring 33 will be in its locked position.

If desired, lock ring 33 may also have a circular pin hole (not shown) that will align with a circular pin hole 45 in cap ring 41 only when lock ring 33 is in the locked position. A pin (not shown) may be inserted through pin hole 45 and the pin hole in lock ring 33 to secure lock ring 33 in the locked position.

As shown also in FIGS. 4 and 7, cap ring 41 has a downward facing shoulder 47 in this embodiment. Shoulder 47 abuts stop shoulder 23 in receptacle 13 when housing 25 is fully inserted. When fully inserted, lock ring segments 35 will be circumferentially aligned with grooved profile 19.

Figure 8:
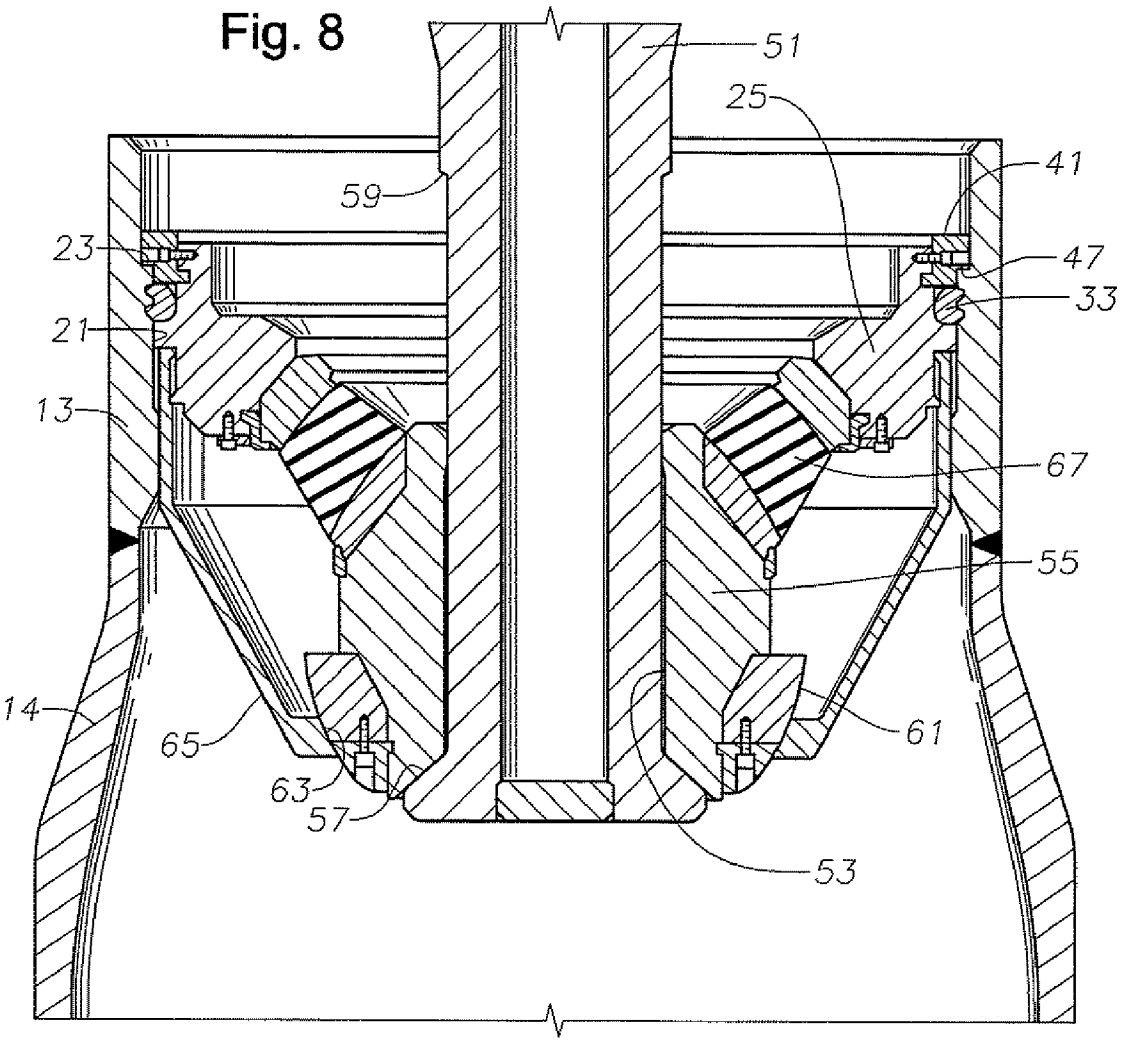
FIG. 8 is a sectional view of the connector of FIG. 1, shown stabbed into the receptacle and the shaft under tension.
Figure 10:
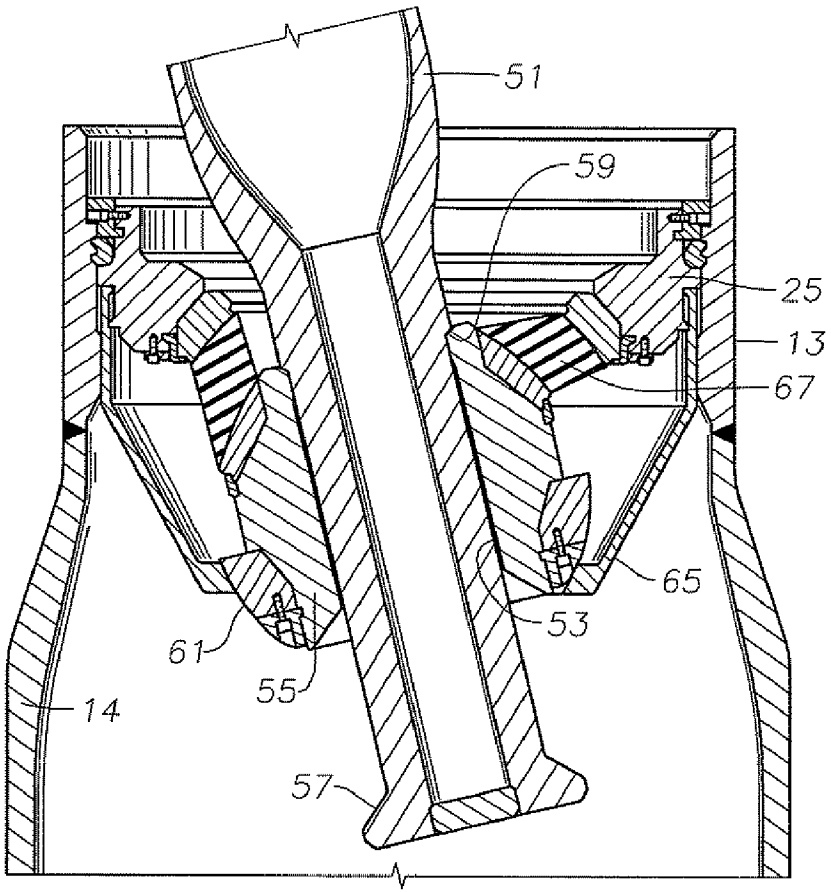
FIG. 10 is a view similar to FIG. 9, but showing the tendon shaft tilted.
Figure 9:
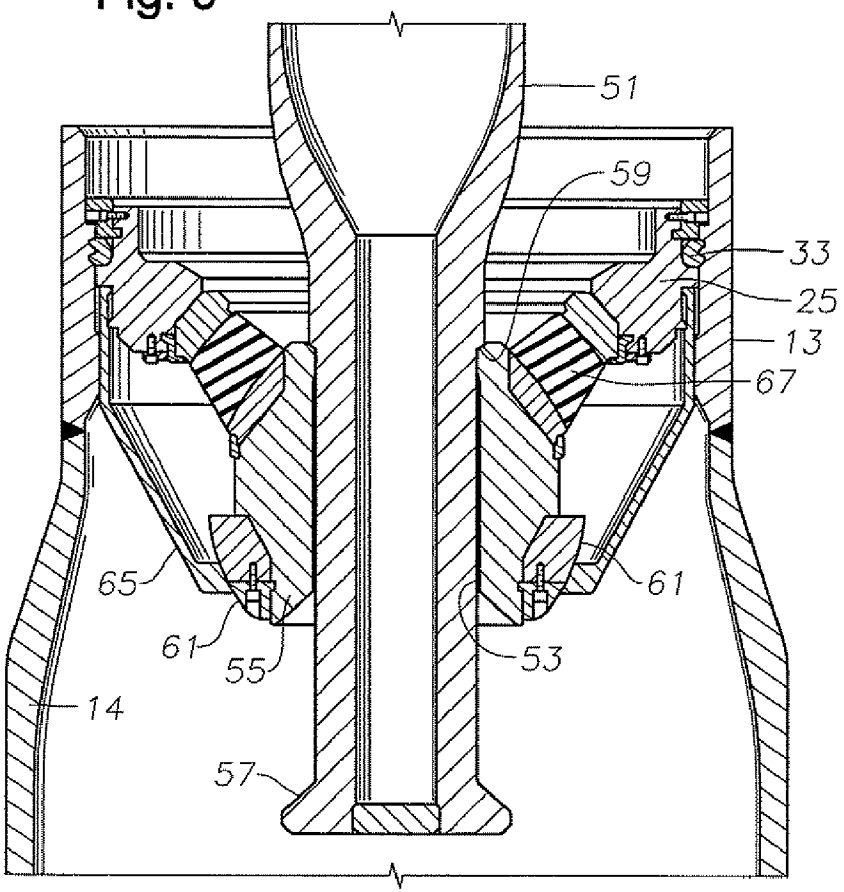
FIG. 9 is a sectional view similar to FIG. 8, but showing the shaft in the absence of tension.

Referring to FIG. 8, housing 25 is carried by a shaft 51 which is secured to the lower end of a tendon (not shown) or a component of a riser tower. Shaft 51 extends slidably through a passage 53 in an inner body 55. Shaft 51 has an external flange 57 on its lower end. Flange 57 is illustrated as being an integral member, but it could be separate and connected to shaft 51 by various means. Flange 57 has a larger outer diameter than passage 53, allowing tension imposed on shaft 51 to be transmitted to inner body 55. Shaft 51 also has a stop shoulder 59 located above inner body 55. Stop shoulder 59 has a larger diameter than passage 53, thus limits how far shaft 51 can move downward. The distance from flange 57 to stop shoulder 59 is greater than the axial length of inner body passage 53 so as to allow a limited amount of axial movement of shaft 51 relative to inner body 55 and receptacle 13. FIG. 8 shows flange 57 contacting inner body 55, with shaft 51 in its uppermost position. FIGS. 9 and 10 show stop shoulder 59 contacting the upper end of inner body 55, with shaft 51 in its lowermost position.

A bearing 61 is secured to the lower end of inner body 53. Bearing 61 has a partially spherical outer surface for engaging a mating central hole 63 in a centralizer 65. Centralizer 65 is a conical or bowl-shaped member that has a greater diameter on its upper end than lower end. The upper end of centralizer 65 is secured to housing 25, which may also be considered to be an outer body. A conventional flex member 67 extends between housing 25 and inner body 55. Flex member 67 allows shaft 51 to incline relative to the axis of receptacle 13, as shown in FIG. 10. The inclination is possible both while shaft 51 is in an upper position, as shown in FIG. 8, and in the lower position shown in FIG. 10. The lower position would rarely occur, if at all, because tension is normally continually maintained on shaft 51.

In operation, to secure connector 11, the operator rotates lock ring 33 to the installation position shown in FIG. 1, where lock ring segments 35 vertically align with housing lugs 27. The operator then lowers housing 25 on shaft 51, which would be attached to a tendon or the like. Housing 25 will stab into receptacle 13, and pointed extensions 31 will guide housing lugs 27 into receptacle slots 21. Downward movement will cease when cap ring shoulder 47 contacts stop shoulder 23, as shown in FIGS. 8-10. The operator then dispenses an ROV to engage arm 39 and rotate lock ring 33 a short distance until lock ring segments 35 engage groove profiles 19 of receptacle segment 17. At this point, arm 39 will be located at the opposite end of elongated aperture 43 from that shown in FIG. 6. The operator may then insert a retainer pin through pin hole 45 to retain lock ring 33 in the locked position.

When bottom connector 11 has been connected, tension will pull shaft 51 upward until its flange 57 bears against the lower end of inner body 55. The tension in shaft 51 passes from inner body 55 to housing 25 and to receptacle 14. In the event of a loss in tension, such as due to extreme waves or current, shaft 51 is free to move downward until its stop shoulder 59 engages the upper end of inner body 55 as illustrated in FIGS. 9 and 10.

Figure 11:
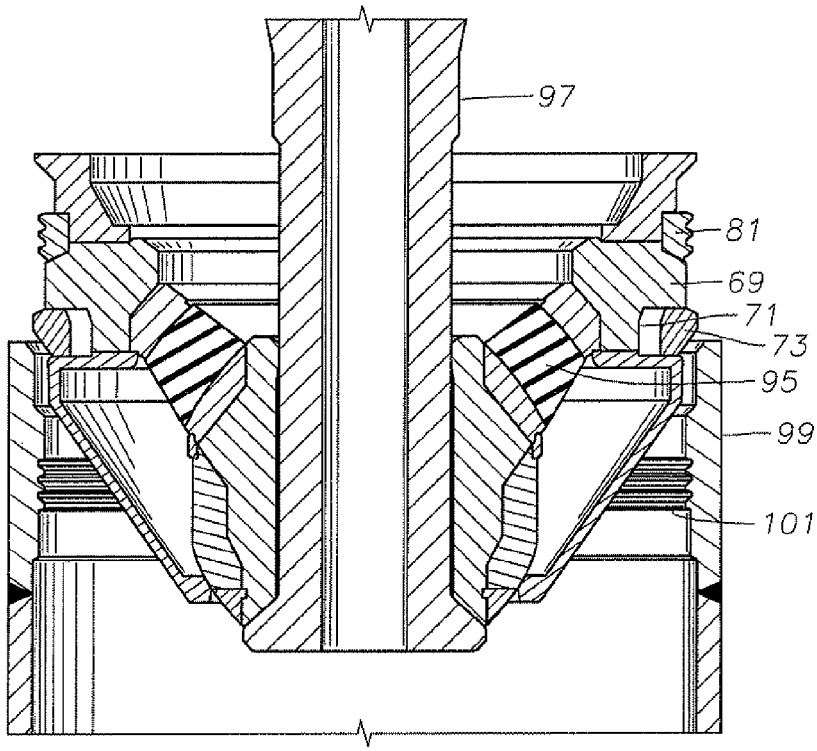
FIG. 11 is sectional view of an alternate embodiment of a connector, shown before stabbing into the receptacle.

In a second embodiment, lock ring 33 (FIG. 1) is automatically shifted into a locked position in response to the downward movement of connector 11 (FIG. 1) into receptacle 13 rather than using arm 39 and an ROV. Referring to FIG. 11, connector housing 69 has a circumferential groove 71. A split ring 73 is carried in groove 71. Split ring 73 has a natural state or condition, such as shown in FIG. 11, wherein it is slightly larger in outer diameter than housing 69. Split ring 73 is contractible to be fully recessed within groove 71.

Figure 12:
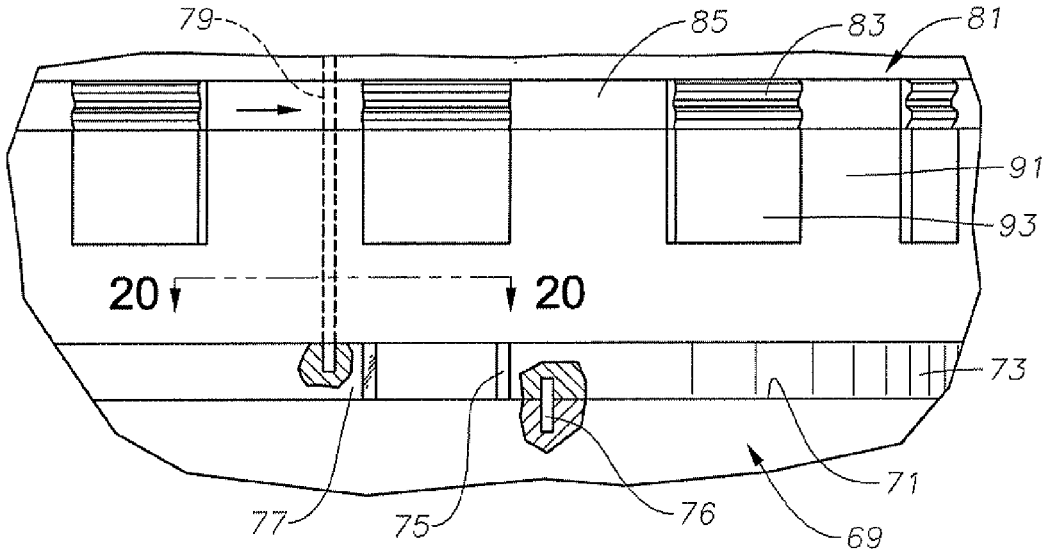
FIG. 12 is an enlarged side elevational view of a portion of the connector of FIG. 11, showing a split ring prior to entry into the receptacle
Figure 13:
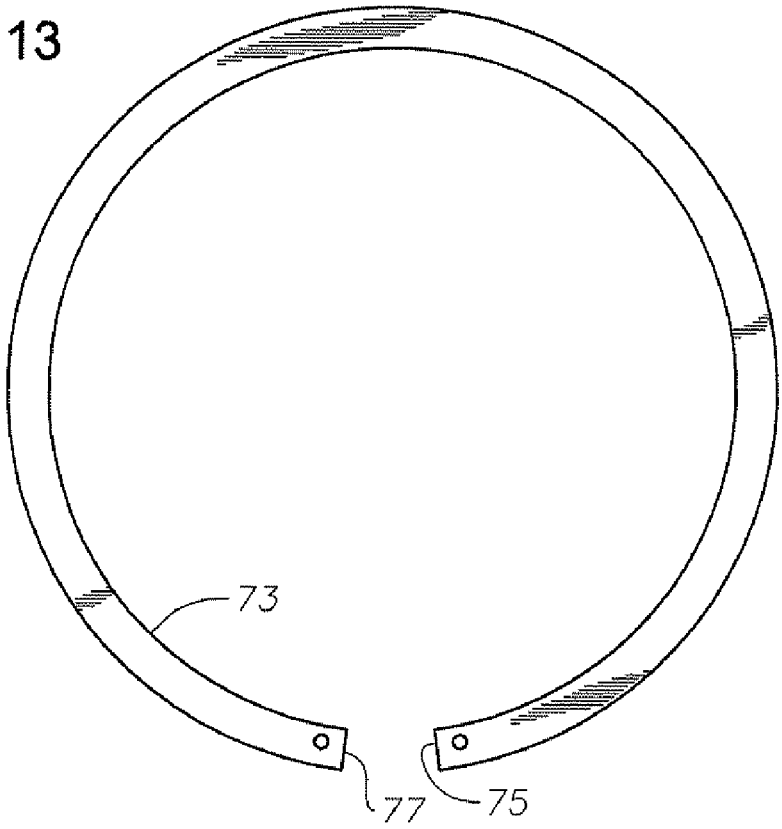
FIG. 13 is a schematic top view of the split ring employed with the embodiment of FIG. 11, shown detached from the connector of FIG. 11 and in the natural, expanded condition.
Figure 14:
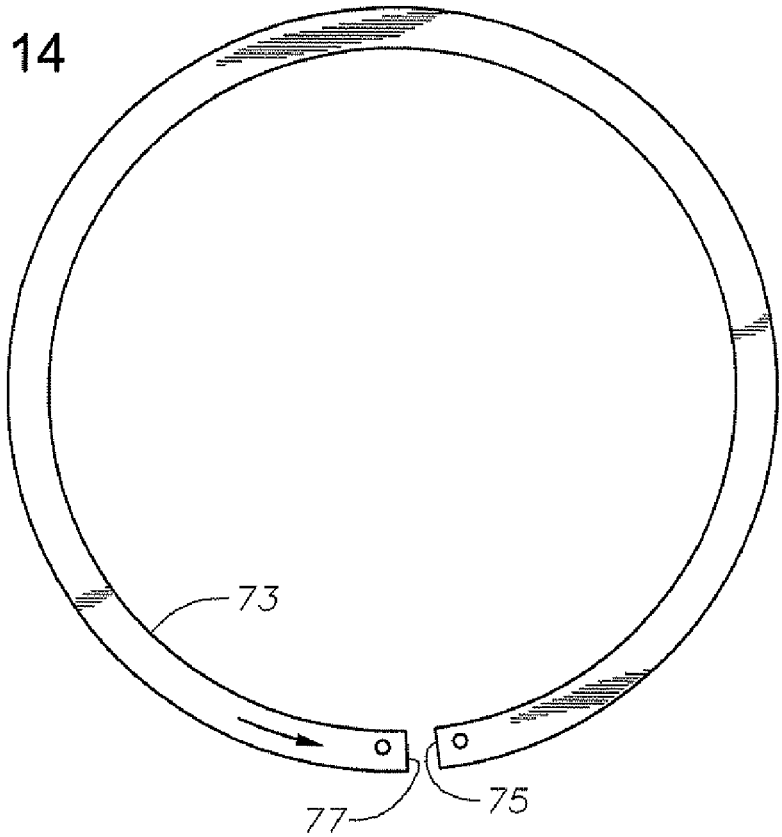
FIG. 14 is a schematic top view of the split ring of FIG. 13, shown in a contracted position.
Figure 20:
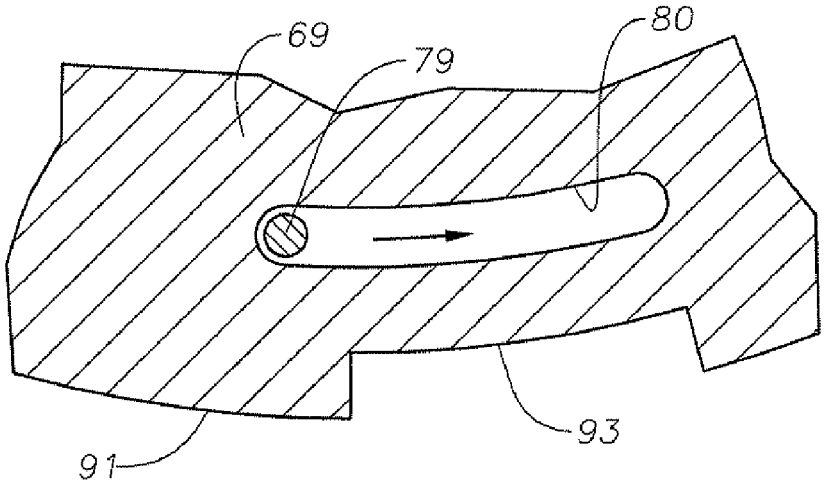
FIG. 20 is a partial sectional view of the housing of the connector of FIG. 11, taken along the line 20-20 of FIG. 12.

Referring to FIG. 13, split ring 73 has a fixed end 75 that is secured to housing 69 (FIG. 11) as indicated schematically in FIG. 13. Split ring 73 has a floating end 77 that moves when split ring 73 is contracted from its natural condition shown in FIG. 13. As can be seen by comparing FIGS. 13 and 14, when split ring 73 is caused to contract, floating end 77 will move closer to fixed end 75 as indicated by the arrow in FIG. 14. Floating end 77 moves in a rotational direction as it moves toward fixed end 75. Referring to FIG. 12, fixed end 75 can be fixed to housing 69 in many different ways and is shown fixed by a pin 76 that extends between fixed end 75 and a portion of housing 69. A rod 79 is shown fixed to floating end 77 for movement therewith. Rod 79 extends through an elongated aperture 80 (FIG. 20) that is formed in housing 69 so as to allow rod 79 to move with floating end 77 toward fixed end 75. Rod 79 extends upward into engagement with a lock ring 81. In this example, lock ring 81 is carried above split ring 73 in a groove and separated from split ring 73 by a portion of housing 69. Lock ring 81 is otherwise constructed the same as in the first embodiment. Lock ring 81 has lock ring segments 83, each of which has a grooved profile on the exterior. Lock ring segments 83 are separated by lock ring slots 85.

Figure 15:
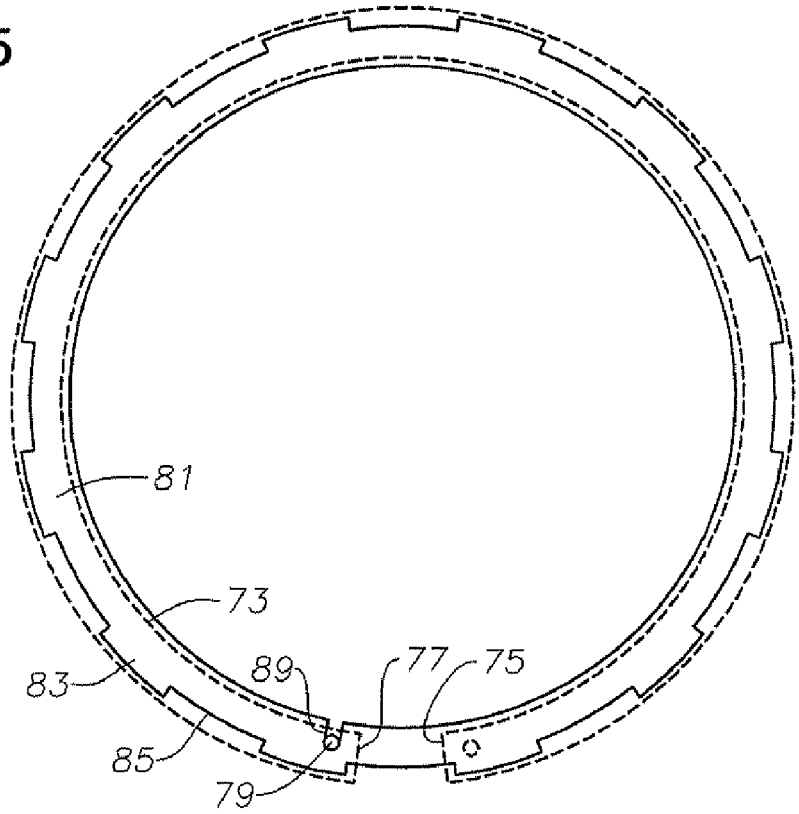
FIG. 15 is a top view of the lock ring of the connector of FIG. 11, shown removed from the connector and showing the split ring in dotted lines and in a natural condition.
Figure 16:
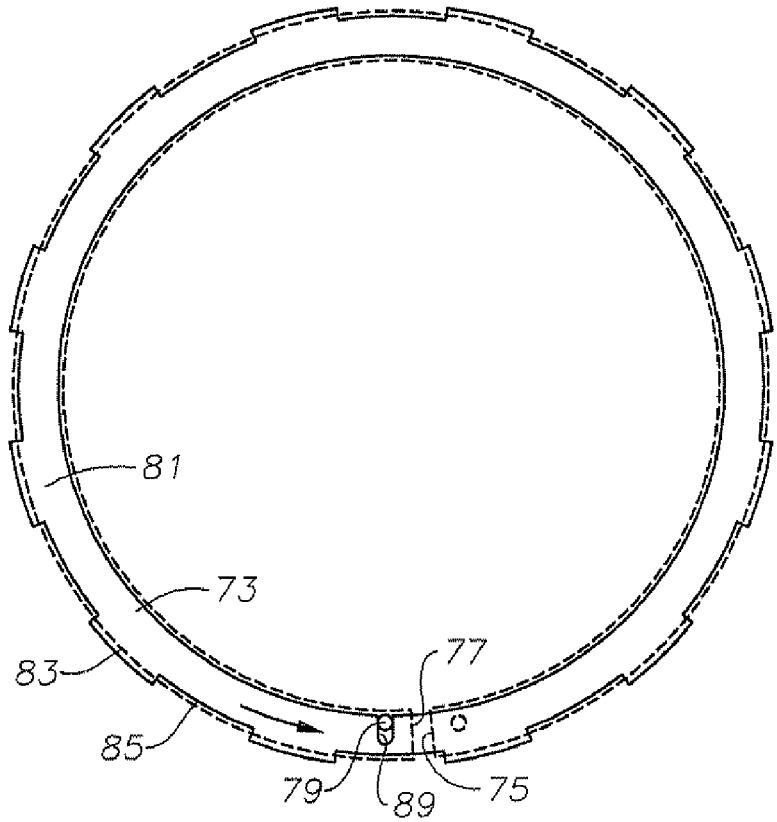
FIG. 16 is a top view of the lock ring of FIG. 15, and showing the split ring in dotted lines in a contracted position.

The distance that floating end 77 moves from the natural state to the contracted state is preferably approximately the same width as one of the lock ring segments 83. As illustrated in FIGS. 15 and 16, rod 79 locates in a vertical groove 89 formed in the inner diameter of lock ring 81. As floating end 77 moves toward fixed end 75, rod 79 will rotate lock ring 81 the width of one segment 83. When expanding back out to the natural state of FIG. 15, split ring 73 will rotate lock ring 81 back to the position shown in FIG. 15.

Referring again to FIG. 12, housing 69 has at least one housing lug 91 in the same manner as the first embodiment. In the preferred embodiment, there are a plurality of housing lugs 91, each separated by a housing slot 93 that is the same width as one of the lock ring segments 83. As shown in FIG. 7, the connector has a flex joint 95 that supports a shaft 97 in the same manner as in the first embodiment.

Receptacle 99 is constructed the same as in the first embodiment, having a plurality of receptacle segments 101, each separated from another by a receptacle slot, such as slot 21 (FIG. 1). The outer diameter of split ring 73 is greater than the inner diameter of receptacle 99 at receptacle segments 101 and equal or less than the inner diameter of receptacle 99 below receptacle segments 101.

In the operation of the embodiment of FIGS. 11-20, prior to entering receptacle 99, lock ring 85 will be in a pre-entry position with its segments 83 spaced above housing slots 93. In the pre-entry position, lock ring segments 83 would interfere with receptacle segments 101, and housing 69 would not be able to fully seat in receptacle 99. In the pre-entry position of FIG. 12, split ring 73 is in its natural, expanded condition with floating end 77 spaced a maximum distance from fixed end 75.

Figure 17:
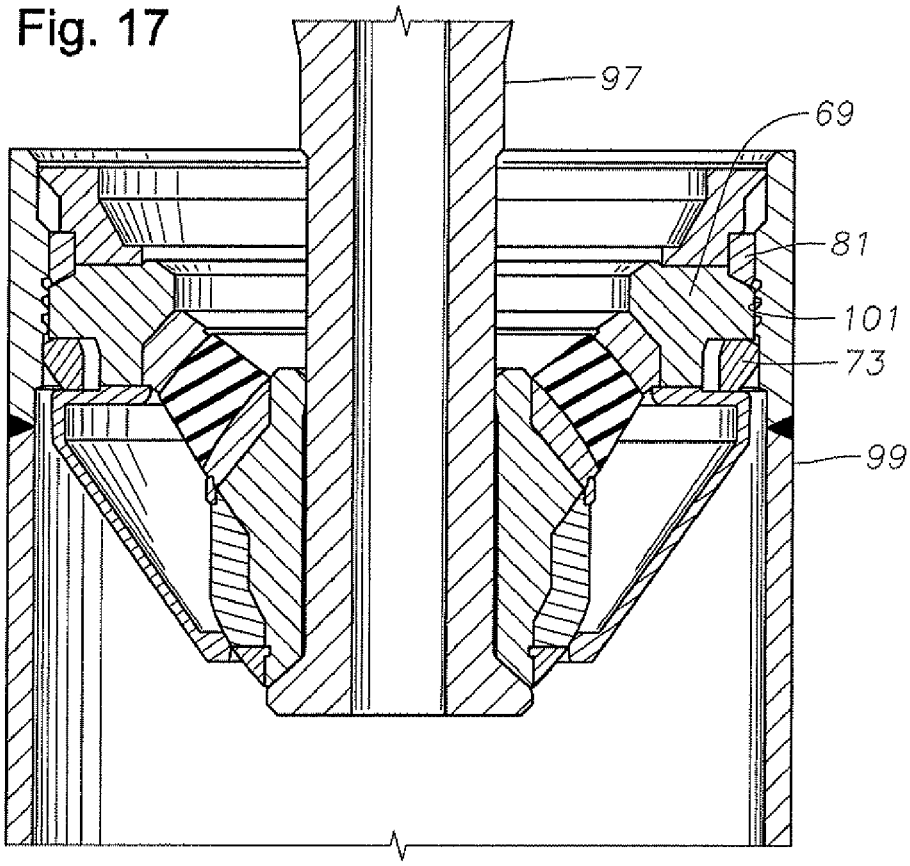
FIG. 17 is a sectional view of the connector of FIG. 11, and shown in partially inserted into the receptacle.
Figure 18:
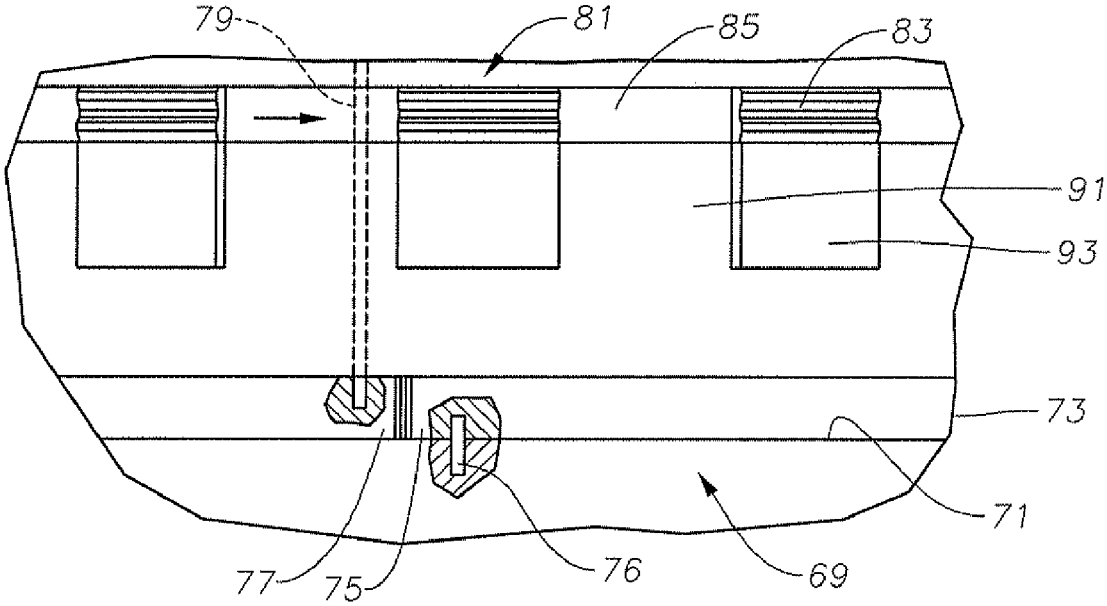
FIG. 18 is a fragmentary side elevational view of a portion of the connector of FIG. 17, showing the split ring in a contracted position.

As split ring 73 contacts the upper ends of receptacle segments 101, as shown in FIG. 17, it will contract. The contraction causes floating end 77 to move closer to fixed end 75, as shown in FIG. 18. Rod 79 will move lock ring 81 rotationally from the pre-entry position of FIG. 12 to the installation position of FIG. 18. In the installation position, lock ring segments 83 now are located above housing segments 93. Lock ring slots 85 will now be aligned with receptacle segments 101 to enable housing 69 to slide to the fully seated position in receptacle 99.

Figure 19:
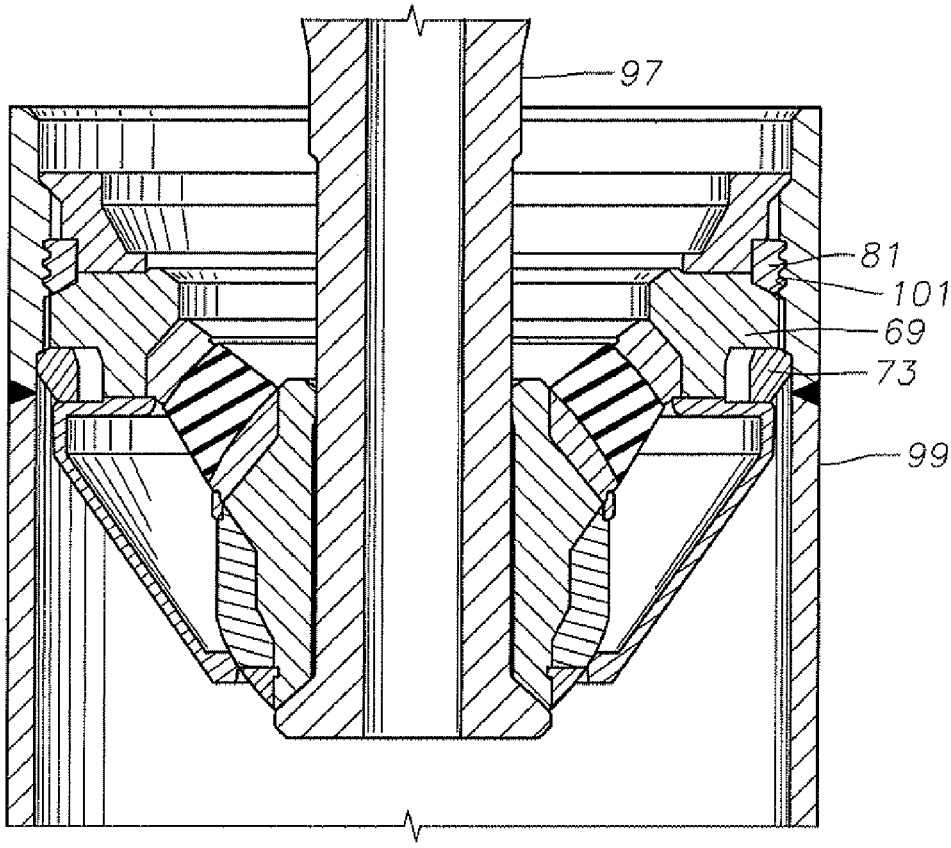
FIG. 19 is a sectional view of the connector of FIG. 11, showing the connector fully inserted and locked in the receptacle.

Referring to FIG. 19, as housing 69 moves downward, split ring 73 will pass below receptacle segments 101 to an area larger in diameter than its outer diameter while in the natural expanded state. This clearance allows split ring 73 to spring outward. Floating end 77 will move away from fixed end 75 to the position shown in FIG. 12. This movement causes lock ring 81 to rotate to the locked position shown in FIG. 12. While rotating, the profiles on lock ring segments 83 will slide into meshing engagement with the profiles on receptacle segments 101. Housing 69 will now be locked to receptacle 99.

To disengage housing 69 from receptacle 99, the user would employ an ROV to stroke arm 39 (FIG. 1), which would move lock ring 81 back to the released position. Arm 39 is not shown in the second embodiment but would be the same as in the first embodiment.

The invention has significant advantages. The receptacle may have considerably less axial length than in the prior art because there is no need to lower the latching portion of the connector assembly below the receptacle locking profile and then pull it upward to latch in place. The connector is quickly moved from an installation position to a locked position with the assistance of an ROV. In the second embodiment, the locking movement occurs automatically. The connector allows downward movement of the shaft without releasing the latch mechanism in the event of loss of tension.

While the invention has been shown in only two of its forms, it should be apparent to those skilled in the art that it is not so limited but is susceptible to various changes without departing from the scope of the invention.

We claim:

1. A subsea connector assembly, comprising:

a receptacle having a bore containing an annular locking profile divided into segments by a plurality of axially extending slots;

a housing that inserts into in the receptacle;

the housing and the receptacle having mating anti-rotation elements to prevent rotation of the housing relative to the receptacle;

a lock ring carried by the housing and having an outer surface with an annular locking profile divided into segments by a plurality of axially extending slots; and the lock ring having an installation position wherein the segments of the lock ring vertically align with the slots of the receptacle to enable the housing to be inserted into the receptacle, the lock ring being rotatable from the installation position to a locked position wherein the segments of the lock ring engage the segments of the receptacle.

2. The assembly according to claim 1, further comprising:

an arm extending from the lock ring for rotationally moving the lock ring.

3. The assembly according to claim 1, wherein the assembly further comprises:

a retainer ring secured to the housing above the lock ring, the retainer ring having an elongated hole formed therein; and an arm protruding upward from the lock ring through the elongated hole for rotationally moving the lock ring.

4. The assembly according to claim 1, wherein the width of each slot in the receptacle is substantially equal to the width of each segment in the receptacle.

5. The assembly according to claim 1, further comprising:

a stop shoulder in the bore of the receptacle;

the stop shoulder being positioned to stop insertion of the housing when the segments of the lock ring become circumferentially aligned with the segments of the receptacle.

6. The assembly according to claim 1, further comprising a shaft mounted to the housing and extending upward from the receptacle, the shaft being axially movable relative to the housing between upper and lower positions.

7. The assembly according to claim 1, further comprising:

a split ring mounted around the housing and having a natural outer diameter that is greater than an inner diameter of the receptacle at the segments of the receptacle, causing the split ring to contract when the split ring contacts the segments of the receptacle;

the natural outer diameter of the split ring being no greater than an inner diameter of the receptacle immediately below the segments of the receptacle, causing the split ring to expand when disengaging from the segments of the receptacle; and one end of the split ring being attached to the housing and the other to the lock ring, so that the contraction of the split ring causes an increment of rotation of the lock ring to the installation position, and the expansion of the split ring causes an increment of rotation of the lock ring to the locked position.

8. A subsea connector assembly for anchoring a buoyant structure, comprising:

a receptacle for securing to a piling embedded in a sea floor, the receptacle having an axial bore defined by an inner wall surface;

a plurality of receptacle segments spaced circumferentially around the inner wall surface of the receptacle, each of the receptacle segments being separated from adjacent ones of the receptacle segments by axially extending receptacle slots, each of the receptacle segments having an inward-facing locking profile;

a shaft for connection to the buoyant structure;

a housing carried by the shaft, the housing having a cylindrical outer surface that inserts the bore;

a flex joint assembly joining the shaft to the housing to enable the shaft to incline relative to the housing;

the housing and the receptacle having mating anti-rotation elements to prevent rotation of the housing relative to the receptacle;

a lock ring mounted to the outer surface of the housing, the lock ring having a plurality of lock ring segments spaced circumferentially around the lock ring, each of the lock ring segments of the lock ring being separated from adjacent ones of the lock ring segments by axially extending lock ring slots, each of the lock ring segments having an outward-facing locking profile; and the lock ring having an installation position wherein the lock ring segments are axially aligned with the receptacle slots to enable the housing to be inserted into the receptacle, the lock ring being rotatable relative to the housing from the installation position to a locked position wherein the lock ring segments slide into mating engagement with the receptacle segments.

9. The assembly according to claim 8, further comprising:

an arm extending upward from the lock ring for rotationally moving the lock ring.

10. The assembly according to claim 8, further comprising:

a retainer ring secured to the housing over the lock ring, the retainer ring having an elongated hole formed therein; and an arm protruding upward from the lock ring through the elongated hole for moving the lock ring rotationally.

11. The assembly according to claim 8, further comprising:

a split ring mounted around the housing and having a natural outer diameter that is greater than an inner diameter of the receptacle at the segments of the receptacle, causing the split ring to contract when the split ring contacts the segments of the receptacle;

the natural outer diameter of the split ring being no greater than an inner diameter of the receptacle immediately below the segments of the receptacle, causing the split ring to expand when disengaging from the segments of the receptacle; and one end of the split ring being attached to the housing and the other to the lock ring, so that the contraction of the split ring causes an increment of rotation of the lock ring to the installation position, and the expansion of the split ring causes an increment of rotation of the lock ring to the locked position.

12. The assembly according to claim 8, further comprising:

a stop shoulder in the inner wall surface of the receptacle;

the stop shoulder being positioned to stop insertion of the housing when the lock ring segments become circumferentially aligned with the receptacle segments.

13. The assembly according to claim 8, wherein the shaft is axially movable relative to the housing between upper and lower positions.

14. The assembly according to claim 8, wherein the anti-rotation elements comprise at least one lug on the outer surface of the housing and at least one of the receptacle slots.

15. The assembly according to claim 14, wherein said at least one lug has a tapered lower end for guiding the lug into alignment with said one of the receptacle slot.

16. The assembly according to claim 8, wherein the shaft comprises a lower end of a tendon of a floating platform.

17. A subsea connector assembly for anchoring a buoyant structure, comprising:

a receptacle adapted to be secured to a piling embedded in a sea floor, the receptacle having an axial bore and an open upper end;

a shaft for connection to a lower end of the buoyant structure;

an inner body having a passage into which a lower portion of the shaft slidingly extends;

a housing surrounding the shaft;

a flex joint assembly joining the inner body to the housing to enable the shaft and the inner body to incline relative to the housing;

a lock member carried by the housing for locking the housing in the axial bore of the receptacle;

a flange on the lower portion of the shaft that is located below the inner body to provide a limit for upward movement of the shaft relative to the inner body when tension is applied to the shaft; and a downward facing shoulder on the shaft above the inner body to provide a limit for downward movement of the shaft relative to the inner body, the axial distance between the flange and the downward facing shoulder being greater than an axial length of the passage in the inner body so as to allow the shaft to move downward relative to the inner body and the receptacle in the event tension on the shaft ceases.

18. A connector assembly, comprising:

an outer member having a bore containing an annular locking profile divided into segments by a plurality of axially extending slots;

an inner member that inserts into the outer member;

a lock ring carried by the inner member and having an outer surface with an annular locking profile divided into segments by a plurality of axially extending slots;

the lock ring having an unlocked position wherein the segments of the lock ring axially align with the slots of the outer member to enable the inner member to be inserted into the outer member, the lock ring being rotatable from the unlocked position to a locked position wherein the segments of the lock ring engage the segments of the outer member;

a split ring mounted around the inner member and having a natural outer diameter that is greater than an inner diameter of the outer member at the segments of the outer member, causing the split ring to contract when the split ring contacts the segments of the outer member;

the natural outer diameter of the split ring being no greater than an inner diameter of the outer member immediately past the segments of the outer member, causing the split ring to expand when moving past the segments of the outer member; and one end of the split ring being attached to the inner member and the other to the lock ring, so that the contraction of the split ring causes an increment of rotation of the lock ring to the unlocked position, and the expansion of the split ring causes an increment of rotation of the lock ring to the locked position.

19. A method of connecting a subsea shaft of a buoyant structure to a receptacle secured to a sea floor, the receptacle having a bore, the shaft being connected by a flex joint to a connector housing that inserts into the bore, the method comprising:

(a) providing an annular locking profile in the bore of the receptacle, the annular locking profile being divided into segments by a plurality of axially extending slots;

(b) providing a lock ring with an outer surface having an annular locking profile divided into segments by a plurality of axially extending slots, and mounting the lock ring on the housing;

(c) aligning the segments of the lock ring with the slots of the housing and inserting the housing into the bore of the receptacle; then (d) rotating the lock ring relative to the housing and the receptacle to a locking position with the segments of the lock ring engaging the segments of the receptacle.

20. The method according to claim 19, wherein step (c) comprises inserting the housing no farther into the receptacle than the point at which the segments of the lock ring circumferentially align with the segments of the receptacle.

21. The method according to claim 19, further comprising:

after step (d), applying tension to the shaft; and if the tension ceases as a results of wave or currents, allowing the shaft to move downward in the receptacle relative to the housing.

22. The method according to claim 19, further comprising:

mounting a split ring around the housing that has a natural outer diameter that is greater than an inner diameter of the receptacle at the segments of the receptacle and no greater than an inner diameter of the receptacle immediately below the segments of the receptacle;

attaching one end of the split ring to the housing and the other to the lock ring; and wherein aligning the segments of the lock ring with the slots of the housing in step (c) comprises contracting the split ring as it contacts the segments of the receptacle; and rotating the lock ring relative to the housing and the receptacle to a locking position in step (d) comprises expanding the split ring as it moves below the segments of the receptacle.

* * * * *